United States Patent [19]

Grant

[11] Patent Number: 4,615,056

[45] Date of Patent: Oct. 7, 1986

[54] FLUSHING CISTERN

[75] Inventor: Rixwell S. Grant, Johannesburg, South Africa

[73] Assignee: Max Rudman, Johannesburg, South Africa

[21] Appl. No.: 797,169

[22] Filed: Nov. 12, 1985

[30] Foreign Application Priority Data

Nov. 20, 1984 [ZA] South Africa ..... 84/9029

[51] Int. Cl.[4] ..... E03D 1/36

[52] U.S. Cl. ..... 4/366; 4/324; 4/390; 4/391; 137/411; 137/434; 137/442; 137/443

[58] Field of Search ..... 4/366, 355, 356, 381, 4/386, 391, 508, 324, 326, 331, 383, 384, 385, 378, 389, 390, 415; 137/411, 423, 430, 433, 420, 434, 442, 443

[56] References Cited

U.S. PATENT DOCUMENTS

| | | | |
|---|---|---|---|
| 354,701 | 12/1886 | Harvey | 4/384 |
| 375,353 | 12/1887 | Harvey | 4/356 |
| 1,262,710 | 4/1918 | Staats | 4/381 |
| 2,745,427 | 5/1956 | Hjulian | 137/420 |
| 3,189,039 | 6/1965 | Bauer | 137/434 |
| 3,561,016 | 2/1971 | Reynolds | 4/324 X |
| 3,831,204 | 8/1974 | Cook | 4/324 X |
| 4,032,997 | 7/1977 | Phripp et al. | 4/415 |

*Primary Examiner*—Henry K. Artis

*Attorney, Agent, or Firm*—Fitch, Even, Tabin & Flannery

[57] ABSTRACT

A flushing cistern includes a flushing device which is located in a liquid-containing cistern. The device includes a hollow tube and a closure member carried by the tube. The tube can be moved in the cistern between open and closed positions in which the closure member is clear of, and seals the cistern outlet. A float is mounted on the tube to hold the tube in the open position while flushing takes place and which causes the tube to resume its closed position at the end of the flush. The device also includes a float arm carrying a float. The float arm is pivoted to a control arm of the inlet valve to the cistern, and there is a detent on the tube which engages the float arm and pulls it downwardly when the flush is over, so operating the control arm and opening the inlet valve to admit further liquid to the cistern. When the cistern has again filled up, the float arm detaches itself from the detent, and permits the inlet valve to close again.

10 Claims, 6 Drawing Figures

Fig. 1
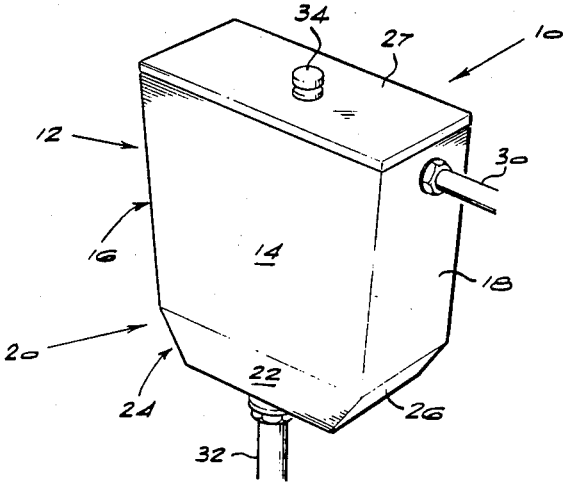
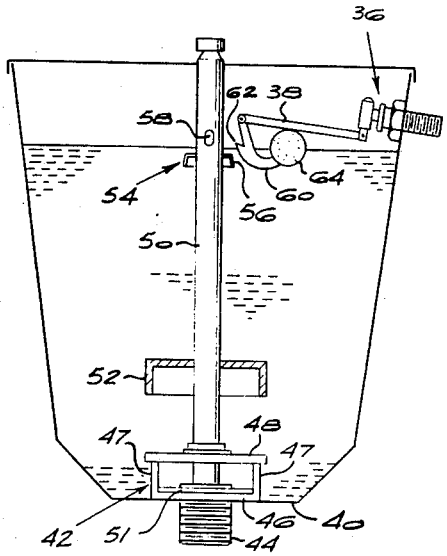
Fig. 2

FLUSHING CISTERN

BACKGROUND TO THE INVENTION

This invention relates to a flushing cistern which is particularly suitable for a toilet.

Of course, many different types of toilet cistern flushing systems are known. In the interests of water conservation, the majority of flushing systems which are designed in present times have as an ideal a situation where the cistern inlet valve only opens to admit replenishing water to the cistern when a predetermined flush has taken place. In this way, none of the fresh replenishing water is wasted during the flush.

In known cistern flushing systems, the quantity of water flushed from a cistern is governed by the inlet supply valve shut off adjustment to achieve a selected water level in the cistern. This procedure results in a weak and inefficient flushing action in the toilet bowl. If a full head of water can be always available in the cistern and other means of controlling the volume of water flushed be used, a lesser quantity of water can more efficiently be utilized for toilet bowl cleansing.

A further advantageous situation arises if the system can be arranged so that, if the cistern outlet valve fails to close properly for some reason, with the result that there is continuous, slow leakage into the WC pan, the inlet valve does not constantly replenish the cistern. Again, if this situation can be achieved, there is less wastage of water.

The present invention seeks to provide a cistern flushing system which has these advantageous features.

SUMMARY OF THE INVENTION

The invention provides a flushing system including a flushing device for use with a liquid containing cistern having an inlet and an outlet, the device comprising a hollow tube, a closure member carried by the tube, the tube being movable in the cistern between open and closed positions in which the closure member is clear of, and seals the outlet respectively, means operable to move the tube to its open position so that flushing takes place from the cistern, buoyant means on the tube which act buoyantly to hold the tube in its open position until a predetermined volume of flush has taken place and which thereafter loses buoyancy to permit the tube to return to its closed position, an inlet valve for controlling the inlet to the cistern and being of a type which has a control arm biased to a position of closure of the inlet valve, a float carried by a float arm pivoted to the control arm, a latch on the float arm, and a detent on the tube, the detent being arranged to engage the latch and move the float arm when the tube returns to its closed position, so moving the control arm to a position in which the inlet valve is open to admit replenishing liquid to the cistern, and the float being arranged to pivot to free the latch from the detent when the replenishing liquid has filled the cistern to a predetermined level with the result that the control arm is free to move to its biased position of closure of the inlet valve.

Preferably, the float is arranged to contact the control arm and maintain it in its position of closure of the inlet valve when the replenishing liquid reaches the predetermined level.

Preferably also, the interior of the tube is in communication with the outlet when in its closed position, the tube having an opening therein serving as an overflow to permit excess liquid to flow from the cistern, through the tube and through the outlet.

The buoyant means may be an inverted cup-shaped float movable as a friction fit on the tube.

BRIEF DESCRIPTION OF THE DRAWINGS

FIG. 1 shows an external perspective view of a toilet cistern fitted with a flushing system of the invention;

FIG. 2 shows a schematic view of the interior of the cistern before a flush;

DESCRIPTION OF AN EMBODIMENT

Figure 3:
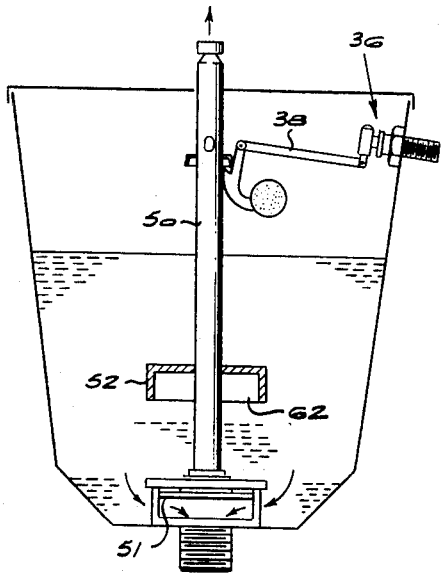
FIG. 3 shows a schematic view of the interior of the cistern during flushing.

The cistern 10 seen in FIG. 1 tapers down in internal cross-sectional area from its top to its bottom. There is an upper portion 12 having a vertical front wall 14 which is parallel to its rear wall, and side walls 16 and 18 which converge downwardly. Adjoining the upper portion 12 is a lower portion 20 which has a vertical rear wall forming a continuation of the rear wall of the upper portion, a front wall 22 which converges downwardly towards the rear wall, and side walls 24 and 26 which converge downwardly. The walls of the cistern are formed as a unitary moulding from plastics material, and there is a separate lid 27 which fits over the upper edges of the upper side walls.

A conventional inlet pipe 30 extends from the water mains to the cistern, which has a conventional outlet pipe 32 extending from its bottom to the toilet bowl. A flushing knob 34 protrudes through the lid 27.

FIG. 2 shows the interior of the cistern in its normal condition i.e. before a flush commences. The inlet pipe 30 (not shown in this figure) is connected to the inlet side of an inlet valve 36, the nature of which is discussed below in detail. Basically it is of a type which seats when closed with the assistance of inlet water pressure. A control arm 38 is pivoted to the body of the valve and is biased in the clockwise direction (as seen in FIG. 2) by the spring which is housed in the valve body. In order to open the inlet valve to admit water to the cistern, the arm 38 must be pivoted downwardly i.e. in the anti-clockwise direction as seen in FIG. 2.

Centrally situated on the bottom 40 of the cistern is an outlet fitting 42 which has a threaded spigot 44 protruding through a hole in the bottom 40 of the cistern 10. The fitting includes a centrally holed base flange 46 seating on the bottom 40 and spaced, upstanding legs 47 supporting an upper flange 48 which is holed centrally to receive a hollow tube 50 carrying a rubber closure member 51 at its lower end. The tube 50 can slide freely through the hole in the upper flange 48 which guides its sliding movement. In use, the outlet pipe 32 of FIG. 1 is connected up to the threaded spigot 44. The interior of the tube 50 communicates with the interior of the pipe 32 and hence with the pan served by the cistern.

An inverted, cup-shaped float 52 is a fairly tight frictional fit on the tube 50, but can be moved up and down on the tube 50 as desired. Fixed to the tube 50 towards its upper end is a detent collar 54 which has a downwardly extending lip 56. A hole 58 is formed through the wall of the tube 50 just above the collar 54.

Figure 4:
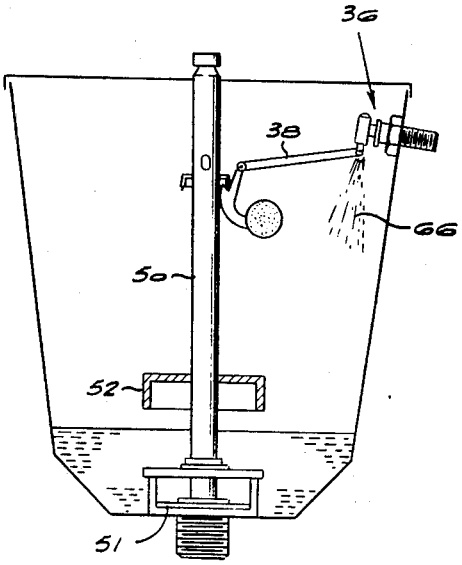
FIG. 4 shows a schematic view of the interior of the cistern at the end of a flush.

Pivoted freely to the end of the control arm 38 is a generally L-shaped arm 60 which carries a projecting, hook-like latch 62. A cylindrical float 64, seen in end view in FIGS. 2 to 4, is secured to the end of the arm 60. When the cistern is full of water, as in FIG. 2, the float rides on the surface of the water and bears upwardly upon the arm 38 to maintain the inlet valve 36 in its closed condition i.e. the float assists the internal valve spring in keeping the valve closed.

When a flush is to be commenced, the knob 34 is pulled upwardly to unseat the closure member 51 from the base flange 46, and water flows rapidly out of the cistern as shown by the arrows in FIG. 3. As soon as the water level in the cistern drops, the float falls under gravity until the latch 62 abuts the tube 50 below the collar 54.

The shape of the cistern leads to rapid flushing. One reason for this is the tapered shape of the cistern which gives rise to a good flow pattern in the water flowing to the outlet. Another reason is the relatively tall and narrow configuration of the cistern, which means that there is a good static head of water at least at the commencement of the flush.

During flushing, the tube 50 is held in its elevated position by the action of the volume 62 of air which the float 52 retains, and the water which rushes around and beneath the float 52. When the water level of water in the cistern drops to about the level of the upper surface of the float 52, it loses its buoyancy, and the tube 50 drops down rapidly to re-seat the closure member 51 on the base of flange 46. The volume of the flush is therefore determined by the position of the float 52 on the tube 50. By adjusting the level of the float on the tube, the volume of the flush can be altered as desired. Although not illustrated, the tube 50 can be externally calibrated so that accurate adjustment of the float to give a desired volume of flush is facilitated.

When the tube 50 drops to re-seat the closure member 51, the collar 54 engages and retains the latch 62, pulling the arm 38 downwardly to open the valve 36. Replenishing water 66 now enters the cistern 10. Note that water replenishment only commences after the flush has ended.

As the cistern fills up again, the rising water eventually encounters the float 64 and raises it. The arm 60 pivots in the anticlockwise direction as seen in the Figures to free the latch 62 from the collar 54. The float then jumps up suddenly into abutment with the underside of the arm 38 to press it upwardly. The valve 36 closes. The combined action of the internal valve spring and the float therefore maintain the valve 36 closed until a new flush takes place. Even if the spring should fail, the float alone is able to maintain the valve 36 in its closed condition.

The hole 58 in the tube 50 serves as an overflow. If the flushing system should for some reason fail and the cistern valve 36 remain open, excess water is able to flow into the hole 58, downwardly through the tube 50 and into the WC pan.

Note also that if the closure member 51 fails to seat properly with the result that there is continuous leakage of water from the cistern, the inlet valve 36 remains closed, so there is no wastage of water through continuous replenishment and leakage.

As previously described, a flush is commenced by pulling upwardly on the knob 34. There may be situations where the cistern 10 is located too high, for example at an elevated position on a wall, for easy hand access to the knob 34.

Figure 5:
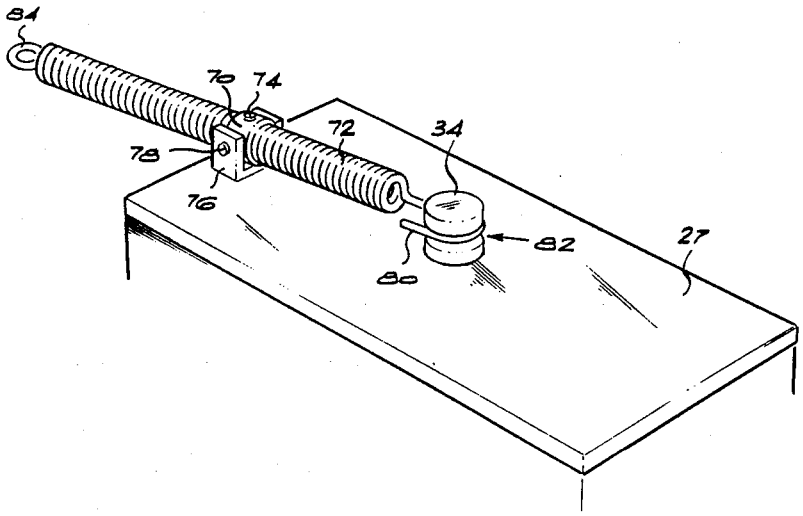
FIG. 5 is a partial perspective view illustrating an operating lever.

FIG. 5 shows a modification to the described apparatus for use in this type of situation. In this Figure, a collar 70 is fastened about a robust, close-wound coil spring 72 by means of a grub screw 74. The collar 70 is supported for pivotal movement about a horizontal axis in a clevis 76 by means of horizontal stub axles 78.

One end of the spring has a hook 80 which locates in a groove 82 in the knob 34. The opposite end of the spring has a hook 84. When the end of the spring with the hook 84 is depressed the knob 34 is raised to start a flush. However, the use of a spring, its particular orientation and mode of support, ensures that the knob 34 is raised even if the end with the hook 84 is not pressed vertically downwardly. In fact, raising of the knob 34 will take place when the end of the spring is moved in any one of a wide variety of directions. This is considered to be an important advantage when compared to conventional rigid flushing handles, because there is little likelihood of damage to the operating parts if a user exerts force on the spring in a non-vertical direction.

In cases where even the spring is not easily accessible to the hand of the user, it is possible to suspend a cord or chain from the hook 84 which terminates at its lower end in a handle at an appropriate height for convenient operation.

Figure 6:
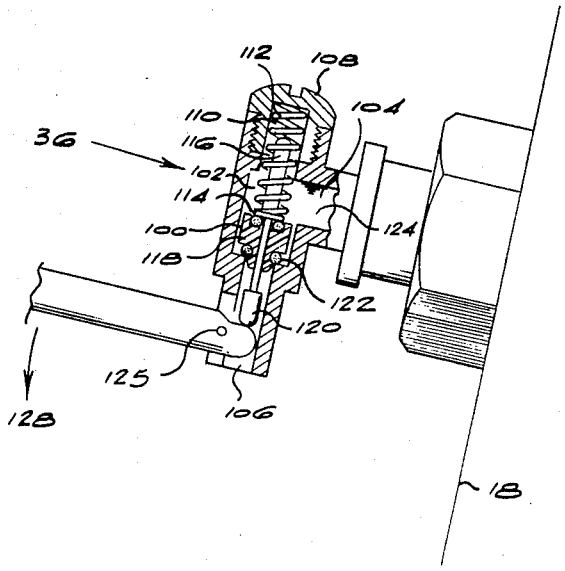
FIG. 6 shows a sectional view of the inlet valve.

FIG. 6 illustrates the valve 36 in more detail. It includes a housing 100 with an internal chamber 102 supplied with mains water via an inlet bore 104 which extends through the side wall 18 of the cistern 10. The chamber has a downwardly directed outlet 106 and its upper end is closed off by a threaded plug 108, removal of which grants access to the interior components.

The plug 108 has a blind bore 110 in which locates one end of a compression spring 112. The opposite end of the spring 112 bears against a collar 114 on a stem 116 which is free to move upwardly into the bore 110. The lower end of the stem passes in sliding fashion through a valve body 118 and terminates in an enlarged head 120. The valve body 118 carries a first O-ring 122 and there is a second O-ring 124 located in a recess in the upper surface of the body. The control arm 38 is pivoted at 125 to the housing 100.

In the closed position of the valve, as illustrated, the spring 112 causes the collar 114 to seat against the O-ring 124 and the O-ring 122 to seat against a shoulder 126 of the housing 100. When the control arm 38 moves downwardly in the direction of the arrow 128 (as described previously), the stem 116 is raised by the end of the arm 38 with the result that the collar 114 is unseated and pressure in the chamber 102 is relieved. Next, the body 118 is raised by the head 120 to open the valve fully to permit replenishing water to enter the cistern 10. When downward force on the arm 38 is removed, it returns under the force of the spring 112 to the illustrated position of closure of the valve.

I claim:

1. A cistern flushing system which includes a flushing device locatable in a cistern having an inlet and an outlet, characterised in that the flushing device comprises a hollow tube, a closure member carried by the tube, the tube being movable in the cistern between open and closed positions in which the closure member is clear of, and seals the outlet respectively, means operable to move the tube to its open position so that flushing takes place from the cistern, buoyant means on the tube which act buoyantly to hold the tube in its open position until a predetermined volume of flushing liquid has excited the tank via said outlet and which thereafter loses buoyancy to permit the tube to return to its closed position, an inlet valve for controlling the inlet to the cistern and being of a type which has a control arm biased to a position of closure of the inlet valve, a float carried by a float arm pivoted to the control arm, a latch on the float arm, and a detent on the tube, the detent being arranged to engage the latch and move the float arm when the tube returns to its closed position, so moving the control arm to a position in which the inlet valve is open to admit replenishing liquid to the cistern, and the float being arranged to pivot to free the latch from the detent when the replenishing liquid has filled the cistern to a predetermined level with the result that the control arm is free to move to its biased position of closure of the inlet valve.

2. The system of claim 1, characterised in that the float is arranged to contact the control arm and maintain it in its position of closure of the inlet valve when the replenishing liquid reaches the predetermined level.

3. The system of claim 1, characterised in that the interior of the tube is in communication with the outlet when in its closed position, the tube having an opening therein serving as an overflow to permit excess liquid to flow from the cistern, through the tube and through the outlet.

4. The system of claim 1, characterised in that the buoyant means is an inverted cup-shaped float movable as a friction fit on the tube.

5. The system of claim 4, characterised in that movement of the cup-shaped float to different positions on the tube results in the use of different predetermined volumes of flushing liquid.

6. The system of claim 5, characterised in that the tube carries calibrations enabling the position of the cup-shaped float on the tube to be set accurately for use of a desired volume of flushing liquid.

7. The system of claim 1, characterized by an operating knob at the operatively upper end of the tube, upward force on the knob resulting in movement of the tube to its open position.

8. The system of claim 7, characterised by a lever for applying upward force to the knob.

9. The system of claim 8, characterised in that the lever is constituted by a spring.

10. The system of claim 1 and including a cistern in which the flushing device is located, characterised in that the cistern is moulded from plastics material to have a rectangular shape in cross-section, the cross-section of the cistern tapering downwardly from its top to its bottom, and in that the cistern has a depth which is considerably greater than its lateral dimensions.

* * * * *